United States Patent [19]

Mayer et al.

[11] Patent Number: 4,519,699

[45] Date of Patent: May 28, 1985

[54] ELECTROPHOTOGRAPHIC COPYING APPARATUS INCLUDING TONER CLEANING ARRANGEMENT

[75] Inventors: Edward F. Mayer; Victor B. van Blerk, both of San Jose, Calif.

[73] Assignee: Ricoh Company, Ltd., Tokyo, Japan

[21] Appl. No.: 552,464

[22] Filed: Nov. 16, 1983

[51] Int. Cl.[3] ..... G03G 21/00

[52] U.S. Cl. ..... 355/15; 15/256.5; 118/652

[58] Field of Search ..... 355/15, 30 D; 101/169, 101/425; 15/256.5, 256.53, 256.51; 118/652

[56] References Cited

U.S. PATENT DOCUMENTS

| | | | |
|---|---|---|---|
| 3,641,969 | 2/1972 | Hakanson | 15/256.53 |
| 3,819,263 | 6/1974 | Draugelis et al. | 355/15 |
| 3,848,992 | 11/1974 | Smith | 355/15 |
| 4,131,359 | 12/1978 | Honda | 118/652 |
| 4,364,660 | 12/1982 | Oda | 15/256.51 |

*Primary Examiner*—A. T. Grimley
*Assistant Examiner*—David Warren
*Attorney, Agent, or Firm*—Flehr, Hohbach, Test, Albritton & Herbert

[57] ABSTRACT

An arrangement for and method of cleaning residue toner from the surface of a photoconductive drum forming part of an overall electrophotographic copying apparatus is disclosed herein. The arrangement utilizes a wiping member, for example a blade or brush, adapted to engage the drum's surface directly as the latter rotates and an assembly of components for moving the wiping member at a continuously controlled speed between a first position in direct engagement with the drum's surface and a second position out of engagement therewith. In one embodiment disclosed herein, this assembly uses a speed damping approach to accomplish speed control and in a second embodiment it uses a combination cam and cam follower.

4 Claims, 5 Drawing Figures

ELECTROPHOTOGRAPHIC COPYING APPARATUS INCLUDING TONER CLEANING ARRANGEMENT

Figure 1:
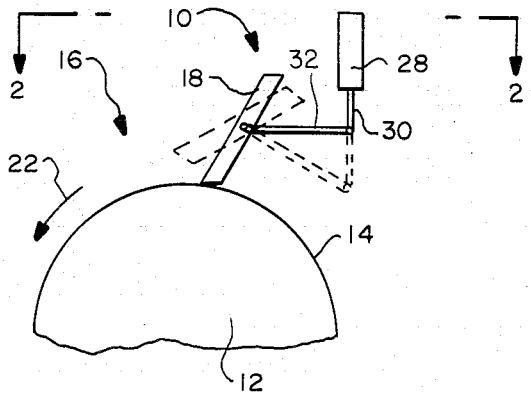

The present invention relates generally to an electrophotographic copying apparatus and more particularly to a specific arrangement for and method of cleaning residue toner from the surface of a photoconductive drum forming part of an electrophotographic copying apparatus.

A typical electrophotographic copying apparatus of the type to which the present invention is directed includes a rotating photoconductive drum, means for placing an electrostatic image corresponding to an original to be copied on the outer circumferential surface of the drum, means for applying toner to the image bearing surface in order to develop the image with toner, and means for transferring the applied toner from the drum surface to a blank sheet of paper so as to transform the latter into a copy of the original. This type of apparatus also includes some sort of arrangement for cleaning residue toner from the drum surface immediately after a copy has been made. Typically, a doctor blade or the like is moved into and out of engagement with the drum surface, as the latter rotates, at the appropriate time by means of a solenoid actuator. While this type of arrangement is generally satisfactory for its intended purpose, it has been found that the solenoid actuated movement of the cleaning blade is sufficiently abrupt to cause residue toner which adheres to the blade to be thrown into the surroundings, possibly causing damage to adjacent equipment.

In view of the foregoing, it is a primary object of the present invention to overcome the problem just recited in an uncomplicated, reliable and yet economical way.

Figure 2:
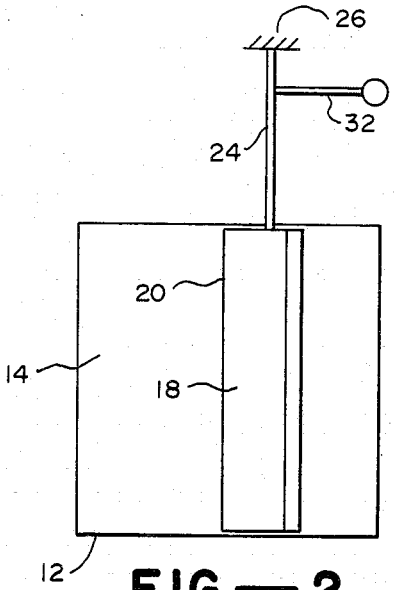
Figure 3:
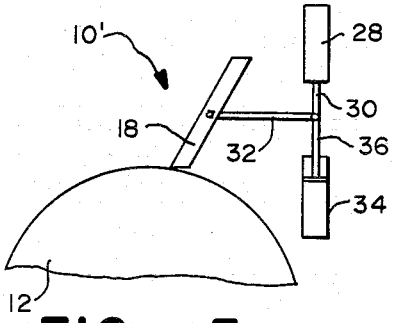
Figure 4:
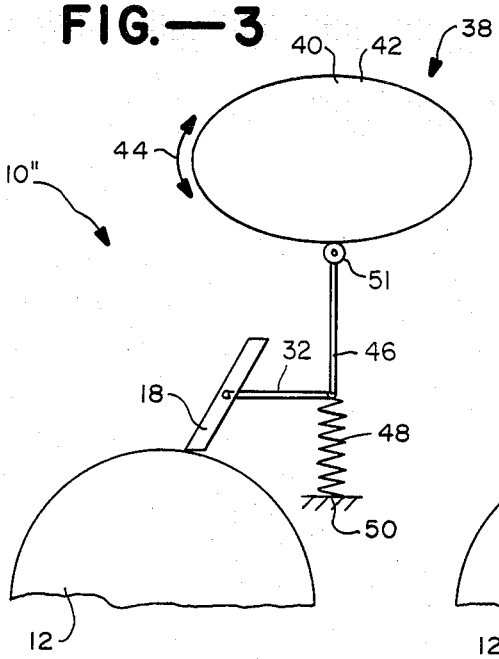
Figure 5:
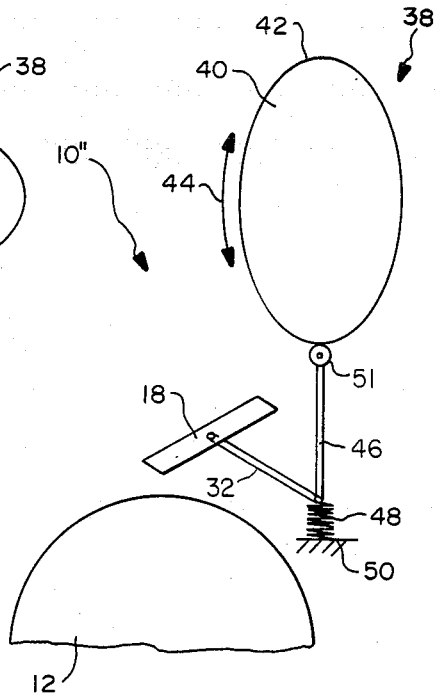

A more specific object of the present invention is to provide a toner cleaning arrangement of the general type just recited but specifically one which includes means for controlling the speed of its cleaning blade as the latter moves into and out of engagement with the photoconductive drum. This prevents the cleaning blade from moving too fast and thereby possibly cause residue toner to be thrown into the surroundings inadvertently. In one embodiment disclosed herein, the speed of the cleaning blade is controlled by means of an actuator which includes a piston type member, means for moving this member back and forth along a straight line path, and means for damping the speed of movement of the piston type member in a predetermined way. The previously recited solenoid actuator in combination with a dashpot can be utilized to this end. In accordance with another embodiment disclosed herein, controlled movement of the cleaning blade is achieved by means of an actuator including a cam and cooperating cam follower. Both of these specific embodiments will be described in more detail hereinafter in conjunction with the drawing wherein:

FIG. 1 diagrammatically illustrates an arrangement for cleaning residue from the surface of a photoconductive drum forming part of an electrophotographic copying apparatus immediately after a copy has been made, and specifically a previously known cleaning arrangement which does not incorporate the present invention;

FIG. 2 is a view of the arrangement of FIG. 1, taken generally along line 2—2 in FIG. 1;

FIG. 3 diagrammatically illustrates a toner cleaning arrangement generally similar to the one illustrated in FIGS. 1 and 2 but incorporating one embodiment of the present invention; and FIGS. 4 and 5 diagrammatically illustrate a toner cleaning arrangement generally similar to the one illustrated in FIGS. 1 and 2 but one which specifically incorporates a second embodiment of the present invention.

Turning now to the drawing, wherein like components are designated by like reference numerals throughout the various figures, attention is first directed to FIGS. 1 and 2 which, as stated previously, diagrammatically illustrate an arrangement for cleaning residue toner from the surface of a photoconductive drum forming part of an overall electrophotographic copying apparatus immediately after a copy of an original has been made from the apparatus. The cleaning arrangement is generally indicated at 10 and the photoconductive drum is shown at 12 including an outer circumferential surface 14. While not shown, the overall electrophotographic copying apparatus which is generally indicated at 16 includes means for rotating drum 12 in a precontrolled way, means for placing an electrostatic image corresponding to an original to be copied on outer surface 14 of the drum, means for applying toner to the image bearing surface in order to develop the image with the toner, and means for transferring the applied toner from the drum surface to a blank sheet of paper so as to transform the latter into a copy of the original. The overall apparatus also includes other means not shown such as a fusing station. However, since these various means do not form part of the present invention, they will not be discussed herein. It suffices to say that immediately after a copy has been made from apparatus 16, there is usually some untransferred toner remaining on drum surface 14. This residue toner must be removed before the copying process can be repeated. As will be seen below, arrangement 10, at least in part, serves to clean this residue toner from the drum surface.

As illustrated in FIGS. 1 and 2, arrangement 10 includes cleaning or wiping means, specifically a cleaning blade 18 having a straight cleaning edge 20 or a wiper brush disposed directly over drum surface 14. As seen in FIG. 2, the cleaning edge extends parallel to the axis of drum 12 and extends the entire length of the latter. While not indicated, the blade is located immediately downstream from the toner transfer station forming part of the overall apparatus, as the drum rotates in the direction of arrow 22.

In addition to the cleaning blade 18, overall arrangement 10 includes a pivot bar 24 mounted for rotation at one end to a fixed support generally indicated at 26 and at its other end to one end of blade 18. In this way, the bar supports the cleaning blade for pivotal movement between a first position in which the cleaning edge 20 of the blade engages drum surface 14 and a second position out of engagement with the drum surface. The blade is shown by solid lines in FIG. 1 in its drum engaging position and by dotted lines in its non-engaging position. The blade is moved between these two extreme positions by means of a known type of solenoid actuator 28 which includes a piston-like actuating arm 30 pivotally connected to one end of a coupling link 32 which has its other end fixedly connected to pivot bar 24. In this way, the solenoid can be energized and de-energized at the appropriate times in order to cause its arm 30 to move back and forth between the solid and dotted line positions shown in FIG. 1. This causes link 32 to move in a corresponding way which, in turn, causes pivot arm 24 to pivot back and forth about its own axis. This latter movement is provided to the extent necessary to cause cleaning blade 18 to move back and forth between its drum engaging and non-engaging positions.

As discussed previously, the utilization of a solenoid actuator such as the one just described tends to pivot blade 18 in a rather abrupt manner. This, in turn, can cause residue toner adhering to the cleaning blade to be thrown into the immediate surroundings inadvertently. As will be seen below, the overall cleaning arrangement 10 has been modified in accordance with two embodiments of the present invention in order to minimize if not entirely eliminate this problem.

Turning to FIG. 3, a cleaning arrangement 10' designed in accordance with one embodiment of the present invention is shown. This overall arrangement may be identical to arrangement 10 to the extent that it includes the same components as arrangement 10. However, arrangement 10' also includes a dashpot 34 and an extension 36 of activating arm 30 which is connected with the dashpot in order to dampen the back and forth movement of arm 30 and therefore the movement of blade 18 between its drum engaging and non-engaging positions. The dashpot itself is of a known type having adjustable pressure valves which can be preset to control the precise amount of damping desired in order to control the speed of movement of the arm 30 and therefore the speed of movement of the blade itself. In this regard, it is to be understood that other movement damping means could be utilized and connected with the solenoid actuator in the appropriate manner. Whether the dashpot 34 is used or another type of damping means, it should be adjusted so that the blade moves sufficiently slow between its two operating positions so as not to cause residue toner to be thrown into the surroundings.

Turning to FIGS. 4 and 5, attention is directed to another cleaning arrangement 10'' which is identical to arrangement 10 to the extent that it includes a cleaning blade 18, a pivot arm 24, an associated support surface 26 (not shown) and a coupling link 32. Arrangement 10'' does not include solenoid actuator 28 but rather a different type of actuator generally designated by the reference numeral 38. This actuator includes a cam member 40 having a specifically contoured cam surface 42 and means (not shown) for rotating the cam member either clockwise or counterclockwise as indicated by two-way arrow 44 in a controlled manner. The actuator also includes a cam follower 46 and means including a compression spring 48 connected to and between one end of the cam follower and a fixed support surface 50 for maintaining the other end of the cam follower in engagement with surface 42 at all times. For this purpose, the other end of the follower may include a roller 51. At the same time, the otherwise free end of link 32 (e.g. the end connected to solenoid actuator 28 in arrangement 10) is pivotally connected to the cam follower for movement therewith.

Having described actuator 38 from a structural standpoint, attention is now directed to the way in which it functions to move cleaning blade 18 between its operating positions. To this end, reference is first made specifically to FIG. 4 which shows the cleaning blade in its drum engaging position. In order to move the blade to its non-engaging position, the cam member 40 is rotated, either clockwise or counterclockwise, until it reaches its FIG. 5 position. As this movement takes place, the eccentric contour of cam surface 42 pushes the cam follower downward, further compressing spring 48. This, in turn, causes the connecting bar 32 to pivot downward, thereby pivoting the cleaning blade out of engagement with the photoconductive drum. Because the cam member can be moved in a controlled, preferably slow fashion, the cam follower can be caused to move in the same manner which, in turn, means that the blade itself then can be caused to pivot from its FIG. 4 position to its FIG. 5 position in the same controlled, slow manner. The blade can be returned to its FIG. 4 position by merely rotating the cam member back to its starting position or, depending upon its design, by rotating it further in the same direction. The compression spring 48 causes the cam follower to follow the cam member during this movement.

What is claimed:

1. In an electrophotographic copying apparatus including a rotating photoconductive drum, means for placing an electrostatic image corresponding to an original to be copied on the outer circumferential surface of the drum, means for applying toner to said image bearing surface in order to develop said image with said toner, and means for transferring the applied toner from said drum surface to a blank sheet of paper so as to transform the latter into a copy of said original, the improvement comprising an arrangement for cleaning residue toner from said drum surface immediately after said copy has been made, said arrangement including:

(a) means adapted to engage said drum surface directly as the latter rotates so as to wipe any residue toner from the engaged surface;

(b) means supporting said wiping means for movement between a first position in direct engagement with said drum surface and a second position out of engagement therewith; and (c) means acting on said supporting means for moving said wiping means between said first and second positions at a controlled speed throughout its movement between these positions, whereby to be able to prevent the wiping means from moving too fast and possibly cause residue toner to be thrown into the immediate surroundings inadvertently, said moving means including a piston type member, means for moving said member back and forth along a straight line path and means for damping the speed of movement of said member in a controlled way, said piston type member and said means for moving it together forming a solenoid and wherein said damping means is a dashpot connected with said member in a way which dampens its back and forth movement in said precontrolled way.

2. The improvement according to claim 1 wherein said wiping means includes a wiper blade.

3. The improvement according to claim 1 wherein said wiping means includes a wiper brush.

4. In an electrophotographic copying apparatus including a rotating photoconductive drum, means for placing an electrostatic image corresponding to an original to be copied on the outer circumferential surface of the drum, means for applying toner to said image bearing surface in order to develop said image with said toner, and means for transferring the applied toner from said drum surface to a blank sheet of paper so as to transform the latter into a copy of said original, the improvement comprising an arrangement for cleaning residue toner from said drum surface immediately after said copy has been made, said arrangement including:

(a) means adapted to engage said drum surface directly as the latter rotates so as to wipe any residue toner from the engaged surface;

(b) means supporting said wiping means for movement between a first position in direct engagement with said drum surface and a second position out of engagement therewith; and (c) means acting on said supporting means for moving said wiping means between said first and second positions at a controlled speed throughout its movement between these positions, whereby to be able to prevent the wiping means from moving too fast and possibly cause residue toner to be thrown into the immediate surroundings inadvertently, said moving means including an actuating mechanism, means for moving said mechanism in a specific way and means for damping the speed of movement of said mechanism in a controlled way, said damping means being a dashpot connected with said mechanism in a way which dampens its back and forth movement in said precontrolled way.

* * * * *